United States Patent [19]

Johnson

[11] 4,322,660

[45] Mar. 30, 1982

[54] STARTING AND OPERATING APPARATUS FOR HIGH-PRESSURE SODIUM LAMPS

[75] Inventor: James C. Johnson, Vicksburg, Miss.

[73] Assignee: Westinghouse Electric Corp., Pittsburgh, Pa.

[21] Appl. No.: 161,541

[22] Filed: Jun. 20, 1980

[51] Int. Cl.[3] ..... H05B 41/231

[52] U.S. Cl. ..... 315/289; 315/283

[58] Field of Search ..... 315/208, 239, 276, 283, 315/289, 290

[56] References Cited

U.S. PATENT DOCUMENTS

| | | | |
|---|---|---|---|
| 3,917,976 | 11/1975 | Nuckolls | 315/283 X |
| 3,963,958 | 6/1976 | Nuckolls | 315/276 |
| 4,072,878 | 2/1978 | Engel et al. | 315/205 |
| 4,143,304 | 3/1979 | Hitchcock et al. | 315/276 |

FOREIGN PATENT DOCUMENTS

| | | | |
|---|---|---|---|
| 52-46684 | 4/1977 | Japan | 315/289 |

*Primary Examiner*—Eugene R. La Roche
*Attorney, Agent, or Firm*—W. D. Palmer

[57] ABSTRACT

A lighting apparatus which provides for high-voltage pulses for starting a high-pressure sodium discharge lamp and thereafter provides operating ballasting. The apparatus uses a single capacitor in series with a blocking diode and a charging resistor. When the voltage on the capacitor reaches a predetermined voltage exceeding the Zener voltage of a parallel Zener diode, the capacitor discharges through a ballast which is connected in autotransformer relationship therewith to provide the high-voltage pulse to start the lamp.

1 Claim, 1 Drawing Figure

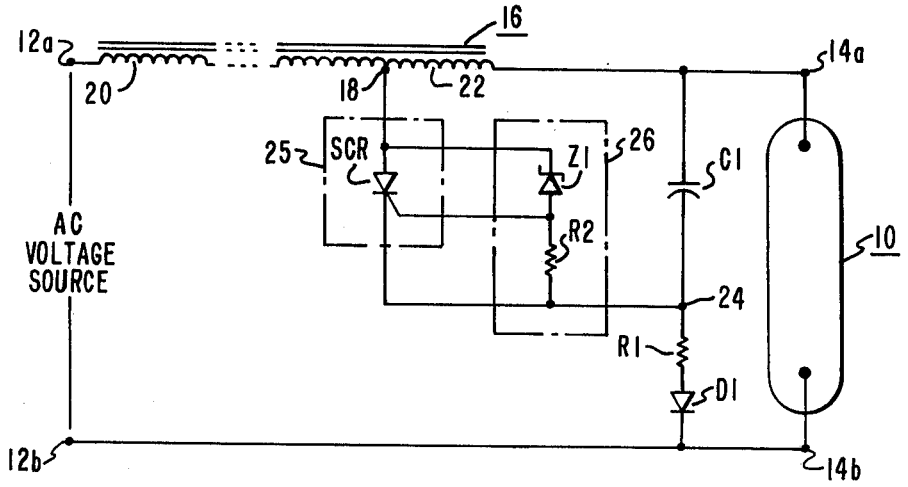
16
12a
20
18
22
14a
25
SCR
Z1
26
C1
R2
10
AC
VOLTAGE
SOURCE
24
R1
D1
12b
14b

STARTING AND OPERATING APPARATUS FOR HIGH-PRESSURE SODIUM LAMPS

BACKGROUND OF THE INVENTION

This invention relates to apparatus for starting and then operating high-pressure sodium discharge lamps and, more particularly, to such apparatus which provides high-voltage pulses for initiating the discharge in such lamps.

A number of high-pressure sodium discharge lamp lighting circuits have been developed in recent years such as that disclosed in U.S. Pat. No. 4,072,878, issued Feb. 7, 1978, to Engel et al. The Engel patent discloses an apparatus that provides for high-voltage pulses for starting a sodium discharge lamp by using the breakdown characteristics of a Zener diode to provide accurately timed starting pulses. The use of the Zener diode eliminates timing problems encountered when the breakdown characteristics of a glow lamp are used in somewhat similar fashion, as described in U.S. Pat. No. 3,917,976, issued Nov. 4,1975, to Nuckolls, and U.S. Pat. No. 3,963,958, issued June 5, 1976, to Nuckolls.

Another apparatus for starting and operating a high-pressure sodium lamp is disclosed in U.S. Pat. No. 4,143,304, issued Mar. 6, 1979, to Hitchcock et al. The Hitchcock apparatus uses a voltage amplification circuit, utilizing two individual capacitors, the output of which is applied across the ballast reactor which is connected to the reactor in autotransformer relationship. This circuit provides a sufficiently high-voltage starting pulse, even when ballast reactors of low open circuit voltage are used to initiate the operation of high-pressure sodium discharge lamps. Although the Hitchcock circuit works well, it does require a relatively large number of circuit components.

SUMMARY OF THE INVENTION

There is provided a relatively simple, efficient and inexpensive starting and operating apparatus for connection across an AC source for starting and then operating a high-pressure sodium discharge lamp.

The apparatus comprises input terminals operable to be connected across the AC source and output terminals which are operable to have the discharge lamp connected thereacross. A ballast inductor has a tap intermediate the ends thereof to define first and second winding portions. The first winding portion has a greater length than the second winding portion and has a transformation ratio therebetween substantially greater than unity. The ballast inductor is connected at its ends in series between one of the input terminals and one of the output terminals with the second winding portion connected to the one output terminal. The other of the input terminals is electrically connected to the other of the output terminals.

The apparatus also comprises a capacitor connected in circuit between a common electrical point and the one output terminal so as to be across the second winding portion of the ballast inductor. A charging resistor is connected in circuit between the common electrical point and the other output terminal. A blocking diode has its anode connected in circuit with the common electrical point and has its cathode connected in circuit with the other output terminal. A gate-controlled solid-state switching means comprises an SCR having its anode connected in circuit with the tap and having its cathode connected in circuit with the common electrical point.

The apparatus also includes Zener diode means comprising a Zener diode. The Zener diode has its cathode connected in circuit with the tap and has its anode connected in circuit with the gate of the SCR. The Zener diode has a predetermined Zener voltage which is greater than the rms voltage for the source but less than the peak voltage of the source. The gate-controlled switching means further comprises a bleeder resistor connected in circuit between the common electrical point and the gate of the SCR.

When the apparatus is initially energized, the capacitor is charged through the charging resistor. Upon the capacitor voltage exceeding the predetermined Zener voltage of the Zener diode, the SCR is gated thereby causing the capacitor to discharge through the second winding portion of the ballast reactor to cause the autotransformer action thereof to apply a voltage pulse of sufficient magnitude across the output terminals to start the lamp connected thereacross. After the lamp is started, the Zener voltage of the Zener diode is not exceeded, thereby rendering the lamp starting portion of the apparatus inoperative.

BRIEF DESCRIPTION OF THE DRAWING

For a better understanding of the invention, reference may be had to the preferred embodiment, exemplary of the invention, shown in the accompanying drawing in which the sole FIGURE is a circuit diagram of the preferred embodiment of the present invention.

DESCRIPTION OF THE PREFERRED EMBODIMENT

In the sole FIGURE is shown a starting and operating apparatus for connection across an AC source for starting and then operating a high-pressure sodium discharge lamp 10. The apparatus comprises input terminals 12*a*, 12*b* operable to be connected across the AC source and output terminals 14*a*, 14*b* operable to have the discharge lamp 10 connected thereacross.

A ballast inductor 16 has a tap 18 intermediate the ends thereof to define a first winding portion 20 and a second winding portion 22, the first winding portion 20 having a greater length than the second winding portion 22, with the first and second winding portions having a transformation ratio therebetween substantially greater than unity. In the specific example as given, the first winding 20 has 240 turns and the second winding 22 has 12 turns. The ballast inductor 16 is connected at its ends in series between one of the input terminals 12*a* and one of the output terminals 14*a* with the second winding portion 22 connected to the output terminal 14*a*. A capacitor C1 is connected in circuit between a common electrical point 24 and the one output terminal 14*a* so as to be across the second winding portion 22 of the ballast inductor 16. A charging resistor R1 is connected in circuit between the common electrical point 24 and the other output terminal 14*b*. A blocking diode D1 has its anode connected in circuit with the common electrical point 24 and its cathode connected in circuit with the other output terminal 14*b*.

A gate-controlled solid-state switching means 25 comprises an SCR having its anode connected in circuit with the tap 18 and having its cathode connected in circuit with the common electrical point 24.

A Zener diode means 26 comprising a Zener diode Z1. The Zener diode Z1 has its cathode connected in circuit with the tap 18 and has its anode connected in circuit with the gate 28 of the SCR. The Zener diode Z1 has a predetermined Zener voltage which is greater than the rms voltage for the source but less than the peak voltage of the source. The Zener diode means 26 further comprises a bleeder resistor R2 connected in circuit between the common electrical point 24 and the gate 28 of the SCR. The bleeder resistor R2 serves to prevent premature gating of the SCR.

In the operation of the foregoing apparatus, when it is initially energized, the capacitor C1 is charged on the positive half cycle through the charging resistor R1. When the charge on the capacitor C1 exceeds the Zener voltage of the Zener diode Z1, the SCR is gated which causes the capacitor C1 to discharge through the second winding portion 22 to cause the autotransformer action thereof to apply a voltage pulse of sufficient magnitude, such as 3000 volts, across the output terminals 14*a*, 14*b* to start the lamp 10 connected thereacross. After the lamp is started, the Zener voltage of the Zener diode Z1 is not exceeded, which renders the lamp starting portion of the apparatus inoperative. The following tables set forth component values for the circuit shown in the sole FIGURE. Table I gives component values for 230 volt operation and Table II gives component values for 120 volt operation.

TABLE I

| | | | |
|---|---|---|---|
| R1 | - 14,000 Ohms | 7 Watt | 5% |
| R2 | - 1,000 Ohms | ½ Watt | 10% |
| C1 | - 0.22 Mfd | 400 VDC | 10% |
| D1 | - IN4005 | (600V 1 AMP) | |
| Z1 | - IN987 | (120V 2 in series) | |
| SCR | - 400 V | 4 AMP | T-106D1 |
| Lamp 10 | - 100 volt (S56), 150 watt, high pressure sodium | | |

TABLE II

| | | | |
|---|---|---|---|
| R1 | - 5,000 Ohms | 7 Watt | 5% |
| R2 | - 1,000 Ohms | ½ Watt | 10% |
| C1 | - 0.33 Mfd | 400 VDC | 10% |
| D1 | - IN4005 | (600V 1 AMP) | |
| Z1 | - IN989 | (150V) | |
| SCR | - 400 V | 4 AMP | T-106D1 |
| Lamp 10 | - 55 volt (S55), 150 watt, high pressure sodium | | |

The component values of R1 and C1 are selected so that the capacitor C1 discharges near the peak of the line voltage during starting. Typically, the capacitor C1 begins charging during one positive half cycle and maintains the charge until the next positive half cycle until its voltage exceeds the Zener voltage of the Zener diode Z1. The diode D1 during the negative half cycle prevents the capacitor C1 from discharging and permits it to charge toward the peak of the line voltage resulting in optimum use of the capacitor during starting. Furthermore, utilizing the diode D1, the energy dissipated in the charging resistor R1 during operation is relatively low since the capacitor charges only once after the lamp is in operation, and therefore, little current will flow through the charging resistor R1 thereby significantly lowering the power dissipation in the resistor. The diode D1 also permits the use of a relatively lower voltage rating for the SCR since D1 blocks reverse voltage and the Zener diode Z1 governs the turn-on in the forward direction.

What is claimed is:

1. A starting and operating apparatus for connection across an AC source for starting and then operating a high-pressure sodium discharge lamp, said apparatus comprising:

(a) input terminals operable to be connected across said AC source, output terminals operable to have said discharge lamp connected thereacross, a ballast inductor having a tap intermediate the ends thereof to define first and second winding portions, said first winding portion having a greater length than said second winding portion and having a transformation ratio therebetween substantially greater than unity, said ballast inductor connected at its ends in series between one of said input terminals and one of said output terminals with said second winding portion connected to said one output terminal, and the other of said input terminals electrically connected to the other of said output terminals;

(b) a capacitor connected in circuit between a common electrical point and said one output terminal so as to be across said second winding portion of said ballast inductor;

(c) a charging resistor connected in circuit between said common electrical point and said other output terminal;

(d) a blocking diode having its anode connected in circuit with said common electrical point and having its cathode connected in circuit with said other output terminal;

(e) gate-controlled solid-state switching means comprising an SCR having its anode connected in circuit with said tap and having its cathode connected in circuit with said common electrical point;

(f) Zener diode means comprising a Zener diode, said Zener diode having its cathode connected in circuit with said tap and having its anode connected in circuit with the gate of said SCR, said Zener diode having a predetermined Zener voltage which is greater than the rms voltage for said source but less than the peak voltage of said source, said Zener diodes means further comprising a bleeder resistor connected in circuit between said common electrical point and said gate of said SCR, whereby when said apparatus is initially energized, said capacitor is charged through said charging resistor, upon said capacitor voltage exceeding said predetermined Zener voltage of said Zener diode, said SCR is gated thereby causing said capacitor to discharge through said second winding portion to cause the autotransformer action thereof to apply a voltage pulse of sufficient magnitude across said output terminals to start said lamp connected thereacross, and after said lamp is started, the Zener voltage of said Zener diode is not exceeded, thereby rendering the lamp starting portion of said apparatus inoperative.

* * * * *